US007057489B2

(12) United States Patent
Nathasingh et al.

(10) Patent No.: US 7,057,489 B2
(45) Date of Patent: Jun. 6, 2006

(54) SEGMENTED TRANSFORMER CORE

(75) Inventors: David M. Nathasingh, Hackettstown, NJ (US); Dung Anh Ngo, Morris Plains, NJ (US)

(73) Assignee: Metglas, Inc., Conway, SC (US)

( * ) Notice: Subject to any disclaimer, the term of this patent is extended or adjusted under 35 U.S.C. 154(b) by 0 days.

(21) Appl. No.: 08/918,194

(22) Filed: Aug. 21, 1997

(65) Prior Publication Data

US 2002/0067239 A1 Jun. 6, 2002

(51) Int. Cl.
*H01F 27/24* (2006.01)

(52) U.S. Cl. ..... 336/234

(58) Field of Classification Search ..... 336/234, 336/217, 216, 213, 233; 29/609
See application file for complete search history.

(56) References Cited

U.S. PATENT DOCUMENTS

| | | | | |
|---|---|---|---|---|
| 2,465,798 | A * | 3/1949 | Grandfield | 336/213 |
| 2,548,624 | A * | 4/1951 | Sclater | 336/217 |
| 3,538,474 | A * | 11/1970 | Olsen | 336/234 |
| 4,364,020 | A * | 12/1982 | Lin et al. | 336/212 |
| 4,450,206 | A * | 5/1984 | Ames et al. | 428/606 |
| 5,063,654 | A | 11/1991 | Klappert et al. | 29/609 |
| 5,134,771 | A * | 8/1992 | Lee et al. | 29/609 |
| 5,285,565 | A | 2/1994 | Ballard et al. | 29/609 |
| 5,327,806 | A | 7/1994 | Houser | 83/636 |
| 5,329,270 | A | 7/1994 | Freeman | 336/213 |
| 5,528,817 | A | 6/1996 | Klappert et al. | 29/564.6 |

FOREIGN PATENT DOCUMENTS

| | | |
|---|---|---|
| EP | 0 503 081 A | 9/1992 |
| EP | 0 576 249 A | 12/1993 |
| JP | 61 015312 A | 1/1986 |
| JP | 61 073316 A | 4/1986 |

OTHER PUBLICATIONS

US 5,155,899, 10/1992, Klappert et al. (withdrawn).
Search Report, no date.
Abstract 61 015312, no date.
Abstract 61 073316, no date.

* cited by examiner

*Primary Examiner*—Tuyen T Nguyen

(57) ABSTRACT

A transformer core comprises a plurality of segments of amorphous metal strips. Each of the segments comprises at least one packet of the strips. The packet comprises a plurality of groups of cut amorphous metal strips arranged in a step-lap joint pattern. Packets thus formed can have C-shape, I-shape or straight segment-shape configurations. Assembly of the transformer is accomplished by placing at least two of the segments together. Core manufacturing is simplified and core and coil assembly time is decreased. Stresses otherwise encountered during manufacture of the core are minimized and core loss of the completed transformer is reduced. Construction and assembly of large core transformers is carried out with lower stress and higher operating efficiencies than those produced from wound core constructions.

18 Claims, 5 Drawing Sheets

3 Phase / 3 Leg Transformer Core (110)

Shell Type 1 Phase (100)

3 Phase / 3 Leg Transformer Core (110)

SEGMENTED TRANSFORMER CORE

BACKGROUND OF THE INVENTION

1. Field of the Invention

The present invention relates to transformer cores, and more particularly to transformer cores made from strip or ribbon composed of ferromagnetic material.

2. Description of the Prior Art

Transformers conventionally used in distribution, industrial, power, and dry-type applications are typically of the wound or stack-core variety. Wound core transformers are generally utilized in high volume applications, such as distribution transformers, since the wound core design is conducive to automated, mass production manufacturing techniques. Equipment has been developed to wind a ferromagnetic core strip around and through the window of a pre-formed, multiple turns coil to produce a core and coil assembly. However, the most common manufacturing procedure involves winding or stacking the core independently of the pre-formed coils with which the core will ultimately be linked. The latter arrangement requires that the core be formed with one joint for wound core and multiple joints for stack core. Core laminations are separated at those joints to open the core, thereby permitting its insertion into the coil window(s). The core is then closed to remake the joint. This procedure is commonly referred to as "lacing" the core with a coil.

A typical process for manufacturing a wound core composed of amorphous metal consists of the following steps: ribbon winding, lamination cutting, lamination stacking, strip wrapping, annealing, and core edge finishing. The amorphous metal core manufacturing process, including ribbon winding, lamination cutting, lamination stacking, and strip wrapping is described in U.S. Pat. Nos. 5,285,565; 5,327,806; 5,063,654; 5,528,817; 5,329,270; and 5,155,899.

A finished core has a rectangular shape with the joint window in one end yoke. The core legs are rigid and the joint can be opened for coil insertion. Amorphous laminations have a thinness of about 0.025 mm. This causes the core manufacturing process of wound amorphous metal cores to be relatively complex, as compared with manufacture of cores wound from transformer steel material composed of cold rolled grain oriented (SiFe). The consistency in quality of the process used to form the core from its annulus shape into rectangular shape is greatly dependent on the amorphous metal lamination stack factor, since the joint overlaps need to match properly from one end of the lamination to the other end in the 'stair-step' fashion. If the core forming process is not carried out properly, the core can be overstressed in the core leg and corner sections during the strip wrapping and core forming processes which will negatively affect the core loss and exciting power properties of the finished core.

Core-coil configurations conventionally used in single phase amorphous metal transformers are: core type, comprising one core, two core limbs, and two coils; shell type, comprising two cores, three core limbs, and one coil. Three phase amorphous metal transformer, generally use core-coil configurations of the following types: four cores, five core limbs, and three coils; three cores, three core limbs, and three coils. In each of these configurations, the cores have to be assembled together to align the limbs and ensure that the coils can be inserted with proper clearances. Depending on the size of the transformer, a matrix of multiple cores of the same sizes can be assembled together for larger kVA sizes. The alignment process of the cores' limbs for coil insertion can be relatively complex. Furthermore, in aligning the multiple core limbs, the procedure utilized exerts additional stress on the cores as each core limb is flexed and bent into position. This additional stress tends to increase the core loss resulting in the completed transformer.

The core lamination is brittle from the annealing process and requires extra care, time, and special equipment to open and close the core joints in the transformer assembly process. Lamination breakage and flaking is not readily avoidable during this process of opening and closing the core joint. Containment methods are required to ensure that the broken flakes do not enter into the coils and create potential short circuit conditions. Stresses induced on the laminations during opening and closing of the core joints oftentimes causes a permanent increase of the core loss and exciting power in the completed transformer.

SUMMARY OF THE INVENTION

The present invention provides transformer core construction which can be assembled from a plurality of core segments. Each of the core segments comprises at least one packet of cut amorphous metal strips. The packet comprises a plurality of groups of cut amorphous metal strips arranged in a step-lap joint pattern. Packets thus formed can have C-shape, I-shape or straight segment-shape configurations. Assembly of the transformer is accomplished by placing at least two of the segments together.

The construction is especially suited for assembly of three phase transformers having three core limbs and permits construction of three phase transformers having higher operating induction. Core manufacturing is simplified and core and coil assembly time is decreased. Stresses otherwise encountered during manufacture of the core are minimized and core loss of the completed transformer is reduced. Construction and assembly of large core transformers is carried out with lower stress and higher operating efficiencies than those produced from wound core constructions.

BRIEF DESCRIPTION OF THE DRAWINGS

The invention will be more fully understood and further advantages will become apparent when reference is had to the following detailed description and the accompanying drawings, in which.

DETAILED DESCRIPTION OF THE INVENTION

Figure 1:
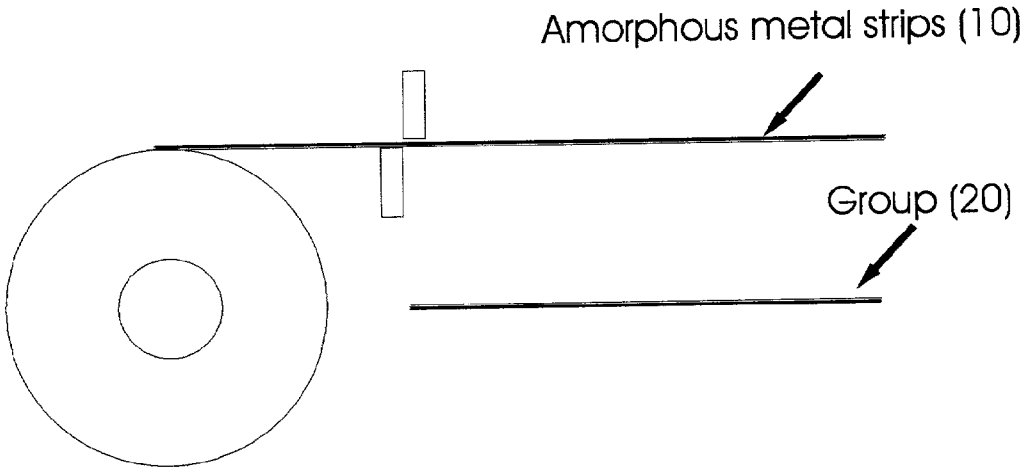
FIG. 1 is a side view of a wound reel on which is housed an amorphous metal strip appointed to be cut into a group of strips.
Figure 2:
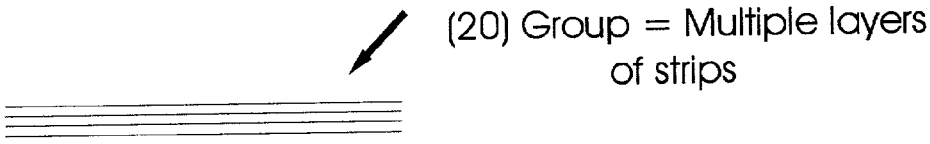
FIG. 2 is a side view of a cut group comprised of a plurality of layers of amorphous metal strip.
Figure 3:
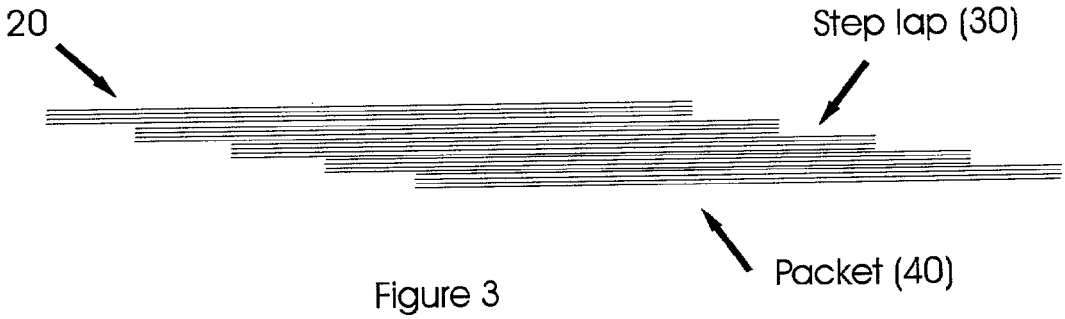
FIG. 3 is a side view of a packet comprising a predetermined number of cut groups, each group being staggered to provide an indexed step lap relative to the group immediately below it.
Figure 4:
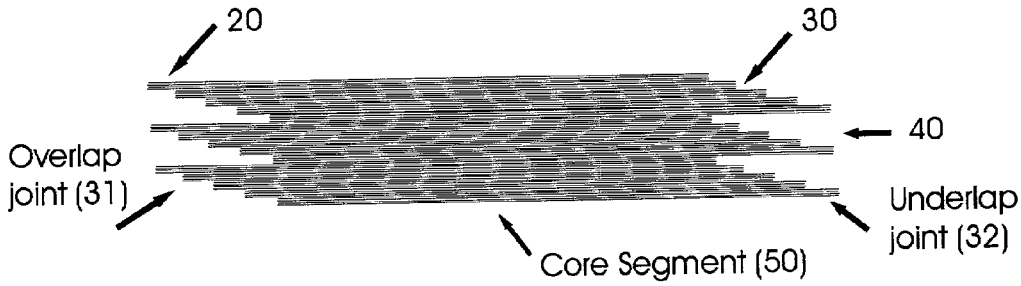
FIG. 4 is a side view of a core segment comprising a plurality of packets, an overlap joint and an underlap joint.
Figure 5:
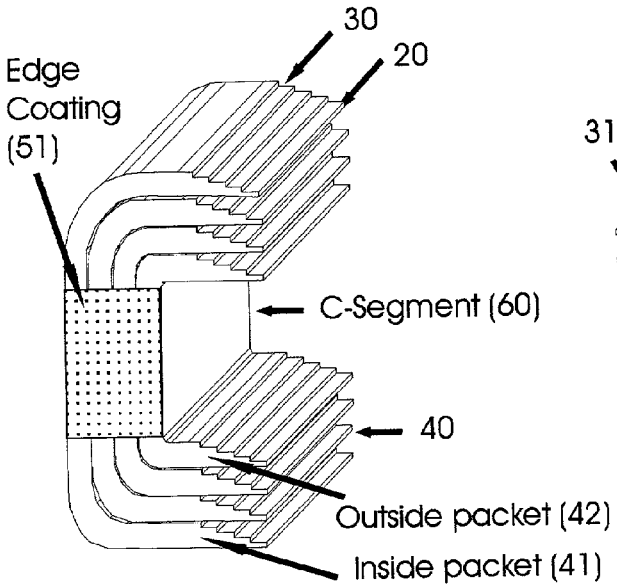
FIG. 5 is a perspective view of a inside packet, outside packet, C-segment formed into shape from a core segment, and an edge coating.
Figure 6:
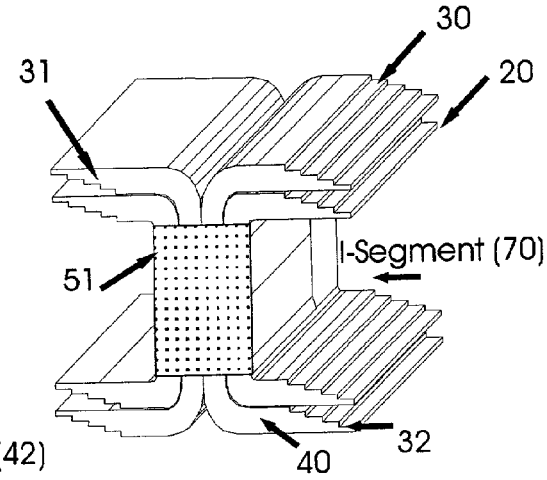
FIG. 6 is a perspective view of an I-segment formed into shape from a core segment.
Figure 7:
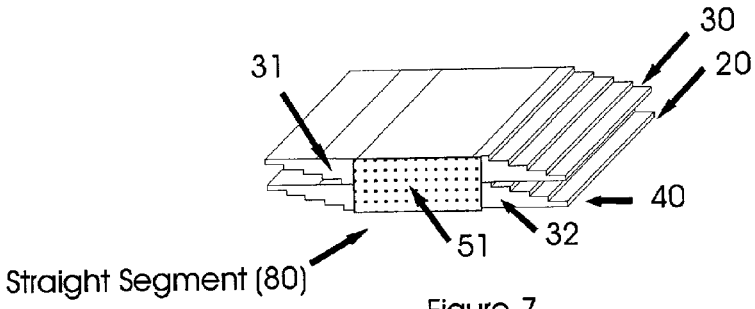
FIG. 7 is a perspective view of a straight segment as shaped from a core segment.
Figure 8:
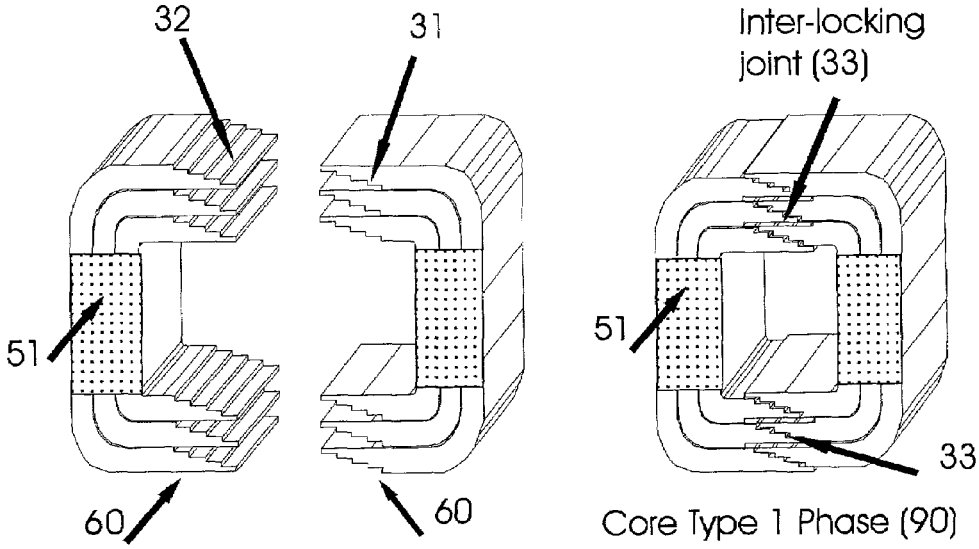
FIG. 8 is a perspective view of a Core type 1 phase made from two C-segments, and inter-locking joint.
Figure 9:
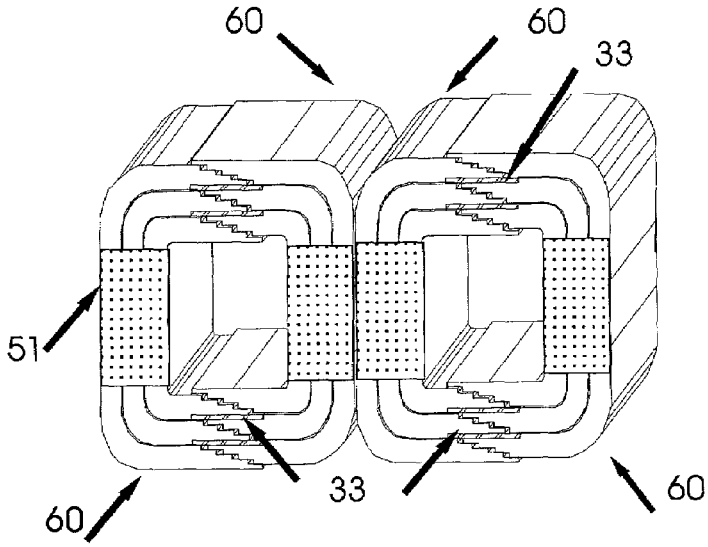
FIG. 9 is a perspective view of a Shell type 1 phase made from four C-segments.
Figure 10:
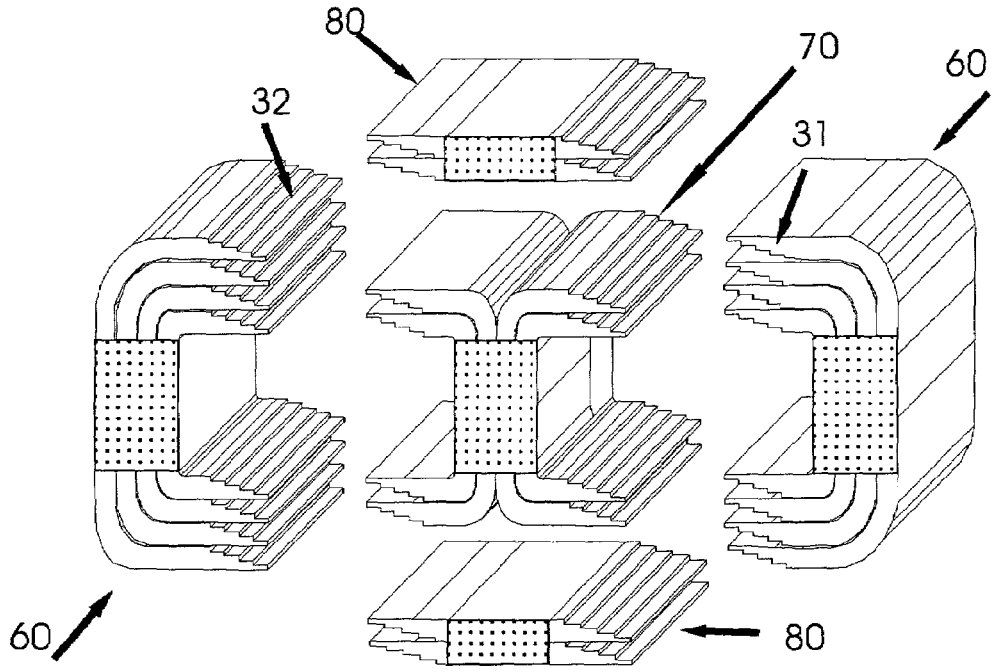
FIG. 10 is a perspective view of the core segments of a 3 phase/3 leg transformer core comprising two C-segments, one I-segment, and two straight segments.
Figure 11:
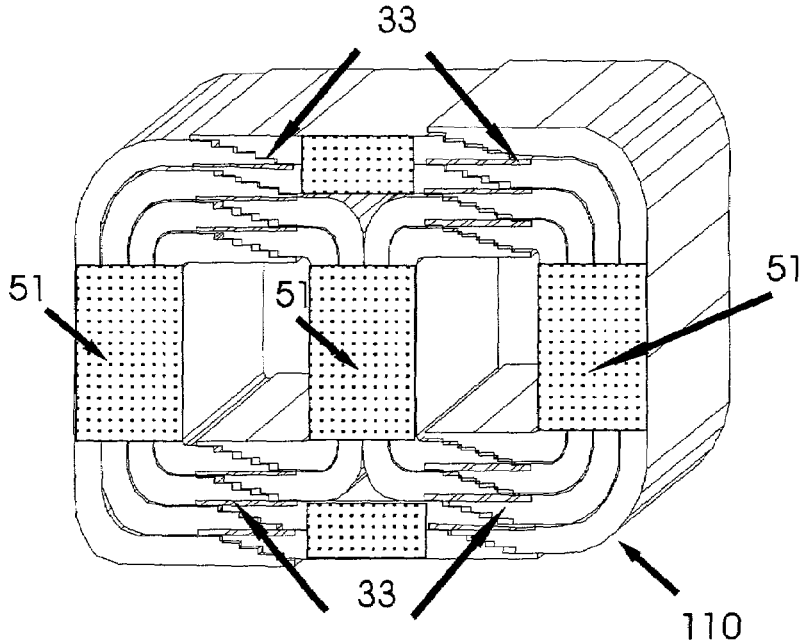
FIG. 11 is a perspective view of an assembled 3 phase/3 leg transformer core, and two straight segments.
Figure 12:
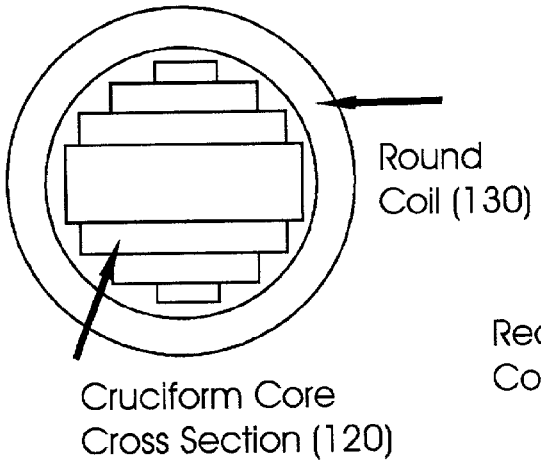
FIG. 12 is a top plan view of a cruciform core cross section and round coil.
Figure 13:
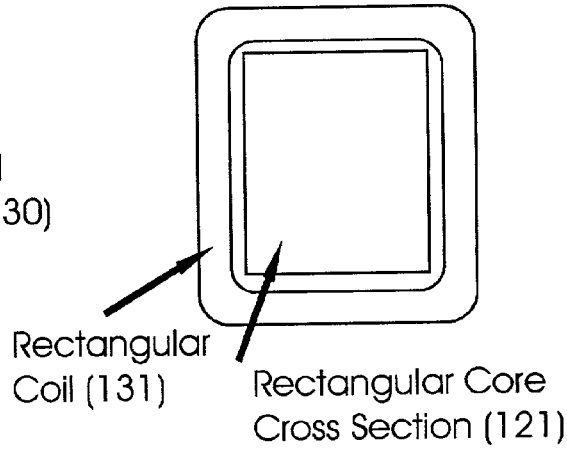
FIG. 13 is a sectional view of a rectangular core and rectangular coil.
Figure 14:
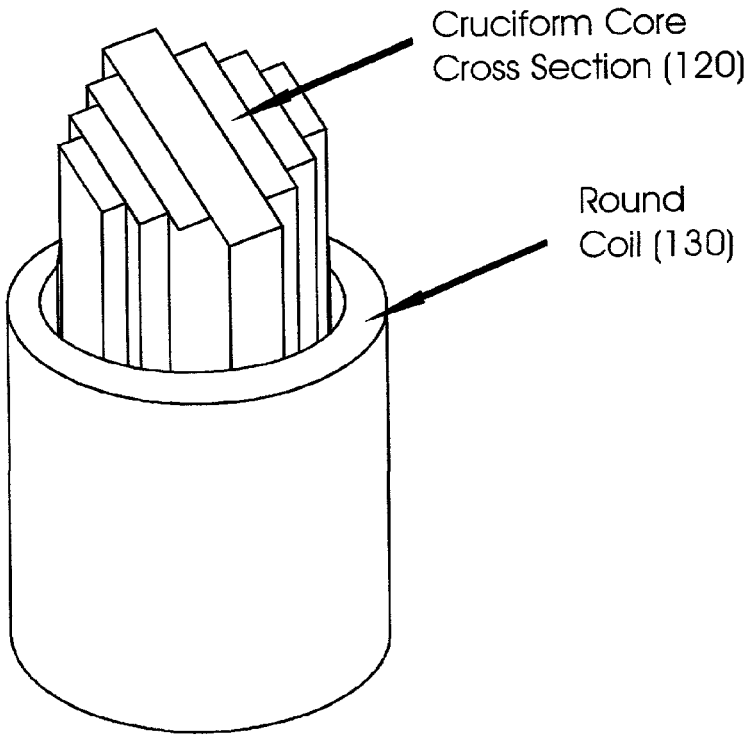
FIG. 14 is a dimensional view of a cruciform core cross section and round coil.

In accordance with the present invention, the transformer core segment comprises a plurality of packets of amorphous metal strips. Each packet 40 is made up of a predetermined number of groups 20 of amorphous metal strips and each group is made up of at least one section of multiple layer amorphous metal strips 10. The sections of amorphous metal strips are made by cutting to controlled lengths a composite strip of multiple layer thickness of amorphous metal ribbon. Each lamination group is arranged with its end in a step lap 30 position. The lamination groups of the packets are arranged such that the step lap joint pattern is repeated within each packet. The number of step-laps in each packet could be the same or increasing from the inside packet 41 to the outside packet 42. The core segment 50 is made up of the required number of lamination packets to meet the build specifications of the core segment.

The C-segment 60 is formed from a core segment 50 with the appropriate cutting length of laminations from the inside to the outside to ensure that both ends of each packet are essentially aligned once the segment is formed into shape. The cutting length increment is determined by the thickness of lamination grouping, the number of groups in each packet, and the required step lap spacing. The inside length of the C-segment is half of the full size core inner circumference plus allowances for the step-lap joint spacing at both ends of the lamination strips. The C-segment is produced by forming the core segment on a rectangular mandrel with the proper dimensions to fit around the transformer coil.

The I-segment 70 is made up of two similar C-segments 60. The C-segments are matched together in a back-to-back configuration. One segment is arranged as the inverse mirror reflection of the other segment. This means that, for the top and bottom step-lap joint sections, one of the C-segments has the step-lap joints facing up and the other C-segment has the step lap joints facing down. This configuration provides the means for one side of the I-segment to be the under-lap joint 32, and the other side as the over-lap joint 31. This is the preferred configuration for assembling the transformer core.

The straight-segment 80 is a core segment comprising packets having equal lengths of lamination grouping. Starting and ending lengths for the respective groups of each packet are the same. Step-lap joint profile position is the same for each packet of lamination groups. The number of packets in a straight segment is determined by the build of the segment required to satisfy the core magnetic area of the particular transformer operating induction.

The formed C-segment 60, I-segment 70, and straight-segment 80 is annealed at temperatures of about 360° C. while being subjected to a magnetic field. As is well known to those skilled in the art, the annealing step operates to relieve stress in the amorphous metal material, including stresses imparted during the casting, winding, cutting, lamination arranging, forming and shaping steps. The segment retains its formed shape after the annealing process. The edges of the segment, excluding the step-lap joint area, are coated or impregnated with epoxy resin 51 to hold the lamination and packets together, and also to provide mechanical strength and support to the segment for the subsequent coil assembly and transformer manufacturing steps.

The manufacturing process for these core segments, C-segment 60, I-segment 70, and straight segment 80 can be carried out much more efficiently than the process conventionally used for manufacture of amorphous metal wound cores. The process conventionally used for cutting and stacking of lamination groupings 20 and packets 40 is carried out with a cut to length machine and stacking equipment capable of positioning and arranging the groups in the step-lap 30 joint fashion. The lamination cutting, grouping, and packet arrangement processes can be performed for the individual packets in a manner similar to that of the current process. Depending on the size of the core design base on the transformer kVA rating for amorphous metal wound core, the current cutting and stacking process may have a maximum cutting length or weight limitation in manufacturing due to machine feeding, cutting, and handling capability. However, the core segments can be produced within the process and equipment capability and assembled together for almost any sizes of transformer core. Furthermore, as the sizes increase for the single amorphous metal wound core configuration, it is much more difficult to process, handle, transport, and assemble of transformer coils. Thus multiple combinations of core segments, C's or I's or straight's, can be assembled to make up the full wound core size. As a result, the segmented transformer core permits use of amorphous metal strip in the application of large size transformers, such as power transformers, dry-type transformers, SF6-transformers, and the like, in the range of 100 KVA to 500 MVA.

The conventional forming process of amorphous metal wound core requires a complex alignment process of lamination groups and packets for wrapping around a round /rectangular arbor to form the step-lap joints of each group and packet. This process is done using several different methods of existing practices such as a semi-automatic belt-nesting machine which feeds and wraps individual groups and packets onto a rotating arbor or manual pressing and forming of the core lamination from an annulus shape into the rectangular core shape. In comparison, the forming process of the core segments 50 into the C-segment 60, I-segment 70, and straight segment 80 can be done more efficiently without the need for extensive labor involvement or expensive automatic equipment. For the straight segment 80, the cut and stacked core segment 50 is clamped flat to the required stack build and strapped for annealing. For the C-segment 60, the core segment 50 is formed and strapped around a rectangular mandrel. The core segment is positioned on the mandrel such that the step-lap 30 joint ends, each, formed one half of the full core joint window. This process can be performed with the 'punch and die' concept with the mandrel being the punch and the core segment placed in the die. As the mandrel is pushed down into the die with the core segment, the C-segment is formed. It can then be strapped for annealing. The I-segment 70 is formed with two equivalent annealed C-segments 60. The C-segments are arranged such that one segment has its step lap joint positioned as overlapping 31, whereas the other segment with its step lap joint positioned as under-lapping 32. The two C-segments are bonded together in the leg section to form the I-segment. Also, this forming method for the various core segments imparts less stress to the core lamination as compared to the conventional amorphous metal wound core manufacturing method because it minimizes tensile forces at the corners of the core segment.

The C-segment 60, I-segment 70, and straight segment 80 can be annealed with conventional heat treatment equipment such as batch or continuous furnace. Application of the magnetic field utilized in the anneal can be accomplished through use of circular current coils, which provide a longitudinal magnetic field when the core segments are positioned therewithin. Since the profile of the segments is flat, direct contact heating plates can also be used, practically and economically, for annealing. Also, the non-annulus, flat shape of the segments will facilitate improved annealing cycle with faster heat up and cool down time as compared to the conventional wound core. Furthermore, the annealing cycle time and temperature can be tailored to individual core segments of varying shape, size and properties to achieve an optimum level of material ductility and magnetic performance not readily accomplished with wound amorphous cores. In effect, the resulting core loss of the core segments will be lower than the conventional wound core from lower induced stress during the core segment forming process and also the improved stress relieving effect of annealing. The reduction in annealing cycle time will reduce the brittleness of the annealed amorphous metal core segment laminations. It will also reduce the core annealing cost and lower the resulting core loss of the annealed core segments.

After annealing, the edges of the C-segment 60, I-segment 70, and straight segment 80, excluding the step-lap joint region, are finished with epoxy. The epoxy resin coating 51 is completed on both edges excluding the step-lap joint regions to provide mechanical strength and surface protection for the transformer coil during the core segment and coil assembly process. The epoxy coating can be applied for lamination surface adhesion or inter-lamination impregnation. Both methods are suitable for reinforcing the core segment and surface protection.

Two C-segments 60 are used to assemble the single phase core type 90 transformer. Four C-segments 60 or two C-segments 60 and one I-segment 70 are used to manufacture the single phase shell type 100 design. The three phase, three leg transformer core 110 is constructed using two C-segments 60, one I-segment 70, and two straight segments 80. This three phase construction has significant advantages over the conventional wound core three phase, 5 leg design. A higher design induction is possible because of the equal build of core yoke and leg. Lower transformer losses are achieved by a three leg design, owing to lower core leakage flux. The footprint of the transformer is reduced by having three core legs instead of five. The single phase and three phase transformer core configurations can be constructed with other possible combinations of C-segment 60, I-segment 70, and straight segment 80 not mentioned above.

The construction and shape of the C-segment 60, I-segment 70 and straight segment 80 makes it possible to assemble these segments in an 'interlocking' 33 fashion by inserting the segments together. Hence, the time consuming process steps required to effect opening and closing of the wound core joints are eliminated. The construction and shape of the segments allows each coil to be assembled on each segment individually instead of having to work on multiple core limbs at one time. This 'snap-on' method significantly simplifies the work process for core and coil assembly. Non-value added time required for opening and closing the joint of the conventional wound core is eliminated. Handling requirements are reduced, core loss destruction factor created by the transformer assembly process is decreased. Other benefits includes significantly faster core and coil assembly time, better quality of core and coil assembly through reduced handling, and less dependency on complex transport and assembly equipment such as upending machine and lift tables. Furthermore, since each segment is independently assembled with the coil, it is possible to mix and match the assembled segments on the basis of their magnetic properties to optimize the performance of the finished transformer.

An alternative method for assembling the coil onto the transformer core comprises the step of directly winding the low and high voltage windings directly onto the core leg. This step is facilitated by the core segment construction. When manufacturing the core segment, each segment is formed and reinforced with the bonding material coating. The mechanical sturdiness of the core segment allows it to be used as a coil winding mandrel. The low and high voltage windings can be assembled directly onto the core leg. Advantages resulting from this method of construction include less coil mandrel tooling, efficient design clearances between core and coil, improved fitting of coil on core leg, and decreased core stressing and joint flaking. In addition, the alternative method for assembling the coil onto the transformer described herein permits a reduction of material usage as well as labor required for assembly of the core and coils, and improves the magnetic performance of the amorphous metal core segments.

The simple, stack-like design of the C-segment 60, I-segment 70, and straight segment 80 makes it practical and economical to manufacture amorphous metal transformer with a cruciform core 120 cross section instead of the conventional square/rectangular 121 cross section. Since each transformer core leg is made up of individual segments, multiple widths of amorphous ribbon segments can be assembled to make up a C-segment 60, I-segment 70, or straight segment 80. Each ribbon width core segment can be cut and stacked individually and assembled together prior to the forming process. The forming process defines the final shape of the core segment and the entire segment with multiple ribbon width can be annealed and edge coated as indicated above. The cruciform cross section core segment 120 can be made up of direct cast-to-width or slit-to-width amorphous ribbon. The assembly process of the core segments and the coils will be the same as shown above. The advantages of cruciform cross section 120 amorphous transformer core include: using round coils 130 instead of rectangular coils 131, and maximizing coil space fill factor. This will benefit many transformer manufacturers who currently have only round coil winding technology. They will not have to invest in costly rectangular coil winding machine to use amorphous metal transformer core.

The transformer core segment construction of the present invention can be manufactured using numerous amorphous metal alloys. Generally stated, the alloys suitable for use in the transformer core segment construction of the present invention are defined by the formula: $M_{70-85}\ Y_{5-20}\ Z_{0-20}$, subscripts in atom percent, where "M" is at least one of Fe, Ni and Co, "Y" is at least one of B, C and P, and "Z" is at least one of Si, Al and Ge; with the proviso that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb. Such segments are suitable for use in voltage conversion and energy storage applications for distribution frequencies of about 50 and 60 Hz as well as frequencies ranging up to the giga-hertz range. Products for which the segmented transformer core of the present invention is especially suited include voltage, current and pulse transformers; inductors for linear power supplies; switch mode power supplies; linear accelerators; power factor correction devices; automotive ignition coils; lamp ballasts; filters for EMI and RFI applications; magnetic amplifiers for switch mode power supplies, magnetic pulse compression devices, and the like. These segmented core containing products can have power ranges starting from about one VA up to 10,000 VA and higher.

Having thus described the invention in rather full detail, it will be understood that such detail need not be strictly adhered to but that various changes and modifications may suggest themselves to one skilled in the art, all falling within the scope of the present invention as defined by the subjoined claims.

What is claimed is:

1. A transformer core comprising a plurality of segments, each of which comprises of a plurality of packets, said packets each comprising a pre-determined number of groups of cut amorphous metal strips arranged in a step-lap joint pattern, each of said segments having been formed and annealed and said core having been assembled from said annealed segments, and wherein at least one core segment has a C-segment, I-segment or straight segment construction.

2. A transformer core according to claim 1, wherein edges of each of said core segments are coated with a bonding material that protects said edges and imparts increased mechanical strength.

3. A transformer core according to claim 1, comprising two C segments.

4. A transformer core according to claim 3, comprising two C segments and an even number of straight segments.

5. A transformer core according to claim 1, comprising four C segments arranged to form a shell-type core.

6. A transformer core according to claim 1, comprising two C segments and one I segment arranged to form a shell-type core.

7. A transformer core according to claim 1, comprising two C segments, one I segment and an even number of straight segments arranged to form a three-leg transformer core.

8. A transformer core according to claim 1, wherein at least one core segment has a cruciform shaped cross-section.

9. A transformer core as recited by claim 1, wherein each of said amorphous metal strips has a composition according to the formula: $M_{70-85}\ Y_{5-20}\ Z_{0-20}$,subscripts in atom percent, where "M" is at least one of Fe, Ni and Co, "Y" is at least one of B, C and P, and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb.

10. A transformer comprising a transformer core according to claim 1.

11. An oil cooled transformer comprising a transformer core according to claim 1.

12. A transformer according to claim 10 having a duty rating of from 100 KVA to 500 MVA.

13. For use in a segmented transformer core, a transformer core segment comprising a plurality of packets, each of which comprises a pre-determined number of groups of cut amorphous metal strips arranged in a step-lap joint pattern, the segment having been formed and annealed and the segment being adapted by the presence of said pattern to be joined in a step-lap joint in said segmented transformer core, said transformer core segment having a C-segment, I-segment, or straight segment construction.

14. An annealed transformer core segment according to claim 13 having a C-segment construction.

15. An annealed transformer core segment according to claim 13 having an I-segment construction.

16. An annealed transformer core segment according to claim 13 having a straight segment construction.

17. An annealed transformer core segment according to claim 13 further comprising a bonding material adhered to edges of said annealed transformer core segment.

18. An annealed transformer core segment according to claim 13 wherein each of the amorphous metal strips has a composition according to the formula: $M_{70-85}\ Y_{5-20}\ Z_{0-20}$, subscripts in atom percent, where "M" is at least one of Fe, Ni and Co, "Y" is at least one of B, C and P and "Z" is at least one of Si, Al and Ge; with the provisos that (i) up to 10 atom percent of component "M" can be replaced with at least one of the metallic species Ti, V, Cr, Mn, Cu, Zr, Nb, Mo, Ta and W, and (ii) up to 10 atom percent of components (Y+Z) can be replaced by at least one of the non-metallic species In, Sn, Sb and Pb.

* * * * *

UNITED STATES PATENT AND TRADEMARK OFFICE

CERTIFICATE OF CORRECTION

PATENT NO. : 7,057,489 B2
APPLICATION NO. : 08/918194
DATED : June 6, 2006
INVENTOR(S) : David M. Nathasingh et al.

It is certified that error appears in the above-identified patent and that said Letters Patent is hereby corrected as shown below:

On the Title page:

item (56) References Cited, U.S. Patent Documents, Col. 1, line 3, change "11/1970" to --11/1968--

Signed and Sealed this

Eighth Day of May, 2007

JON W. DUDAS
*Director of the United States Patent and Trademark Office*